United States Patent [19]

Prather et al.

[11] 4,435,027

[45] Mar. 6, 1984

[54] SELF-LOCKING HINGED DOOR CABINET AND LATCH FOR THE SAME

[75] Inventors: Joseph E. Prather, Bernardsville; Ramzl A. Khalifa, Rutherford; Peter B. Wenzler, Long Valley, all of N.J.

[73] Assignee: Edson Tool & Manufacturing Co., Inc., Belleville, N.J.

[21] Appl. No.: 247,601

[22] Filed: Mar. 25, 1981

[51] Int. Cl.[3] ..... E05C 7/06

[52] U.S. Cl. ..... 312/222; 292/68; 292/341.13; 292/DIG. 40; 312/100

[58] Field of Search ..... 174/66, 50; 312/100, 312/222, DIG. 33; 292/68, DIG. 40, 341.12, 341.13, 213, 214, 217, 116, 117, 118, 119, 120

[56] References Cited

U.S. PATENT DOCUMENTS

| | | | |
|---|---|---|---|
| 2,195,282 | 3/1940 | Pacy | 292/68 X |
| 3,110,438 | 11/1963 | Leckner | 312/222 X |
| 3,286,133 | 11/1966 | Sturdivan | 312/100 X |
| 3,376,086 | 4/1968 | Fisher | 312/100 |
| 3,784,727 | 1/1974 | Haubein | 174/50 X |
| 3,830,499 | 8/1974 | Alldredge | 312/100 X |
| 4,003,610 | 1/1977 | Main | 312/100 |

FOREIGN PATENT DOCUMENTS

| | | | |
|---|---|---|---|
| 795873 | 6/1958 | United Kingdom | 312/100 |

*Primary Examiner*—James T. McCall

*Attorney, Agent, or Firm*—Frishauf, Holtz, Goodman & Woodward

[57] ABSTRACT

Front and back doors of an apparatus cabinet have lips extending around to cover part of both cabinet sides. Both doors are hinged on one side member of the frame of the cabinet and each has a toothed tongue in the middle of its free end directed so as to slide into a dual latch mounted on the inside of the other frame member of the cabinet. In entering the latch, the door tongues are guided upwards to correct for the sag of the doors. The latch has a cross member with a detent on each end urged downward by a leaf spring and mounted on a pivot plate in a manner allowing the plate to slide upwards against the spring when both detents are pushed upwards by simultaneous closing of both doors. The doors are self-locking, whether closed individually or simultaneously. Release of the front door is performed by a finger cam, actuated from the outside, acting on the pivot plate, by means of a special wrench. The rear door is released from the inside after the rear door is opened. A single padlock can lock the two doors together if further security is desired.

11 Claims, 9 Drawing Figures

SELF-LOCKING HINGED DOOR CABINET AND LATCH FOR THE SAME

This invention concerns an improved cabinet of the sheet steel enclosure type having access doors mounted for swinging horizontally for easy maintenance and installation of apparatus enclosed therein and equipped with a latch that automatically locks the door or doors when they are pushed shut and has a limited access type of latch release requiring a tool of a specific configuration to operate it.

Such cabinets are particularly useful for above-ground connection and splice enclosures or other terminal enclosures for buried communication or power cable installations. They are needed in such quantities for such purposes as to justify intensive efforts to develop economical and reliable enclosures for the purpose with an appropriate level of security against tampering by unauthorized persons. They are, of course, available for a wide variety of other uses, both in buildings and in the field.

In recent years, enclosures for communication junction or distribution equipment and the like have been provided in considerable variety with lift-off access doors or panels. For somewhat larger enclosures, however, convenience and saving of time is obtainable with doors that remain on their hinges on most occasions for access to the cabinet interior, and this involves a vertical hinge axis and a horizontal swing of the door. Since the cabinets for which the lift-off type of door is inconvenient are generally not much smaller than one-by-two feet in horizontal dimensions, opening up the wide sides of such cabinets has heretofore involved the necessity of stiffening the doors and/or using a double door to reduce the sag of a sheet steel door, thus greatly complicating the provision of access to both front and back, and requiring more time in opening or closing up.

THE INVENTION

It is an object of the present invention to provide a limit access selflocking cabinet using at least one sheet steel door extending across a wide side, and especially such a cabinet using such a door for each of the two wide sides, both of which can be automatically locked by closing them with a dual latch. A further object of the invention is to provide such a cabinet in which releasing one door to open it is done by a first limited access procedure and releasing the other one is easily done by another procedure that is not readily evident to a stranger, thus providing some further assurance that only persons from the appropriate craft will normally deal with the equipment and/or wiring side of the apparatus enclosed in the cabinet. A further object is to provide a cabinet on which a single padlock and hasp can optionally be mounted for further security in such a way as to lock together the front and the back doors. The attainment of all these objects, moreover, should be provided by a structure utilizing economical materials capable of being formed and assembled economically.

Briefly, the cabinet has a frame comprising first and second side members, each providing a narrow sidewall surface on the narrow side of the cabinet and at least one door for a wide side of the cabinet is hinged on one of these side members, extends all the way across the wide side of the cabinet and latches on a latching device on the other of the side members. The door at each vertical side has a lip extending around the cabinet, one of the lips connected to hinges and the other having a tongue for engaging the latch, the tongue and latch being so designed that as the door is closed, the tongue rides up into the latch correcting the sag of the door. Furthermore, the door is preferably bowed to enable the outer lip to clear the corners at top and bottom where it must fit snugly when closed and as the tongue engages in the latch, not only is the sag of the door corrected, but the bow is straightened out, so that the door can fit snugly at all of its edges, preferably against a slightly compressible sealing strip.

Typically, the cabinet is equipped with front and back doors of identical construction, both hinged on the same frame member (preferably with hinges that permit the door to be lifted off after opening, if desired). In that case, the door tongues engage in a dual latch releasable by a quarter turn of the cam from the outside by means of a suitable tool and so constructed that when one or both doors are pushed shut, they are self-locking and the release procedure must be used to open them.

This dual latch provides a particular aspect of the invention having in itself great advantages. It comprises a cross member having at each end a detent for catching one of the door tongues by a tooth of the tongue. The cross member is pivoted on a sliding pivot and bears against the spring which yields when either of both door tongues displaces its detent. The pivot plate of the cross member has an actuating extension and a rotary cam finger is provided for producing a small rotation of the pivot plate, causing the detent of one of the doors to release the door tongue, as the result of which the door will spring open because of the bow built into it.

It is possible to provide a double-acting cam which can release each door in turn, but it is preferred to leave the release of the other door to the insertion of a tool, such as a screwdriver, through the tongue slots provided for the open door, so as to lift the detent off the other door tongue, an easy operation requiring no special training for the craftsman who needs to have access to the other door.

The pivot plate and the cam actuating shaft are preferably mounted for rotary displacement on a channel-shaped base plate that fits within the channel shape in which it is preferable to make the side members of the frame. The spring acting on the cross member can then be simply a leaf spring mounted in slots in the channel sides of the base plate. The base plate has bent-up stops near each side against which the cross member, through its pivot plate, can bear, instead of bearing against a door tongue, when caused to swing to release the tongue of the other door. Thus, the latch can be provided as a separate assembly simply fitted and fastened to the frame side member, which needs only to be provided with slots for the tongues a hole for the passage to the outside of the actuating shaft for the cam and holes for riveting the latch at three places to the channel.

THE DRAWINGS

The invention is further described by way of illustrative example with reference to the annexed drawings, in which.

DESCRIPTION OF THE ILLUSTRATED EMBODIMENT

Figure 1:
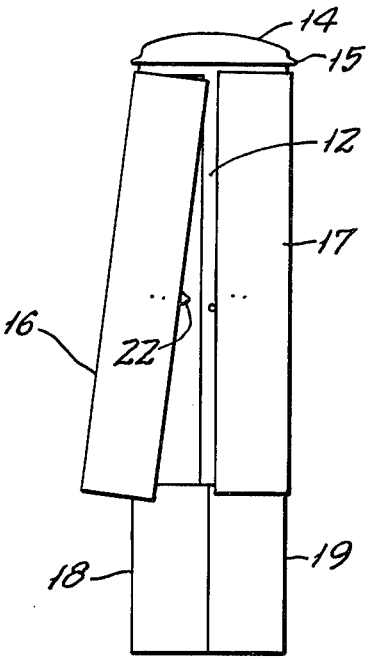
FIG. 1 is a side view from the latch side of a cabinet according to the invention, with the front door shown open to the extent that it springs open when the latch is released, and the rear door still locked shut.
Figure 2:
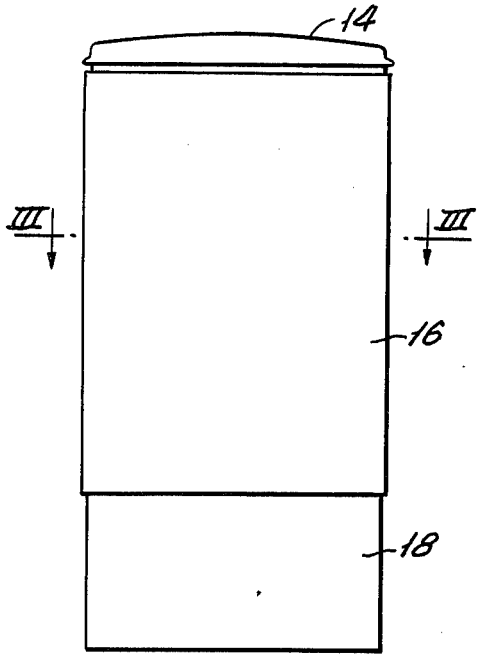
FIG. 2 is a front view of the cabinet of FIG. 1.

FIGS. 1 and 2 show a side view and a front view respectively of a cabinet fitted with a closure latch of the kind illustrated in FIGS. 6–9 in accordance with the invention. This cabinet is of a kind that may be installed out of doors with its base anchored in the ground, through which communication cables are brought up for connection on or to apparatus mounted between parallel upstanding frame members 10 and 12. These lateral members 10 and 12 are of channel shape over most of their length, although at the top they are broadened out in a manner for mounting a covering cap 14, which together with the broadened tops of the frame members 10 and 12 provides a peripheral strip below the rim 15 of the cap 14 against which the doors 16 and 17 may lie snugly, preferably with the interposition of a sealing strip, such as the self-sticking foam tapes commonly used for such purposes. Below the doors are a fixed front wall 18 and a fixed back wall 19 forming the bottom of the enclosure along with whatever base may be provided at the particular site. These pieces of sheet steel have their surfaces, where they join, flush with the outer surface of the frame members 10 and 12 extending thereabove, which means that the frame members 10 and 12 are preferably stepped inwardly slightly by the thickness of the members 18 and 19, so as to provide a flush seating surface for the edges of the doors 16 and 17. Other ways of providing that flush surface are possible, for example modifying the shape of the sheet steel pieces 18 and 19, but it is preferred to provide all the shaping on the frame members 10 and 12, so that the doors and the pieces 18 and 19 can be very simply bent pieces of sheet steel.

Figure 4:
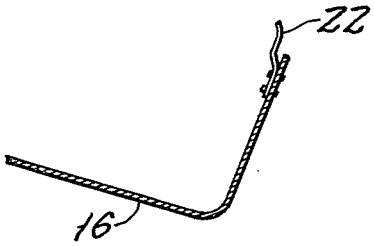
FIG. 4 is a detail of FIG. 3 showing the door tongue on the door lip on a somewhat larger scale.

The doors 16 and 17 are respectively hinged at their edges 20 and 21. At the middle of the edge opposite the hinges, each door is equipped with a tongue, respectively 22 and 23, as shown in more detail for the front door 16 in FIG. 4.

Figure 3:
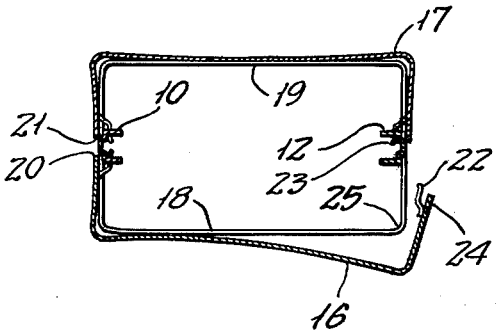
FIG. 3 is a top view at the section III—III designated in FIG. 2.

In the unstressed condition, as when open, each door is bowed outward as shown for the front door in FIG. 3, the bow being slightly exaggerated in that illustration for reasons of clarity. This enables the advancing lip 24 of the door to clear the corner 25 when the door is swung shut from a fully open position. As the door is pushed shut, the bow straightens out and the tongue 22 extends sufficiently inward to fit into a slot in one of the channel sides of the frame member 12, as well as a slot in the latch structure itself, which will be described below, where it will be caught and held in the closed position illustrated in FIG. 3 for the rear door 17.

Because of its width and weight, the door 16 sags as shown in FIGS. 1 and 2 when it is not held in the latch. As will be presently explained in connection with the latch structure, the tongue 22 rides up in the slot in the latch unit, correcting the sag before the door is caught fast in the closed position. The sag has been somewhat exaggerated in FIG. 1 for purposes of illustration.

Figure 5:
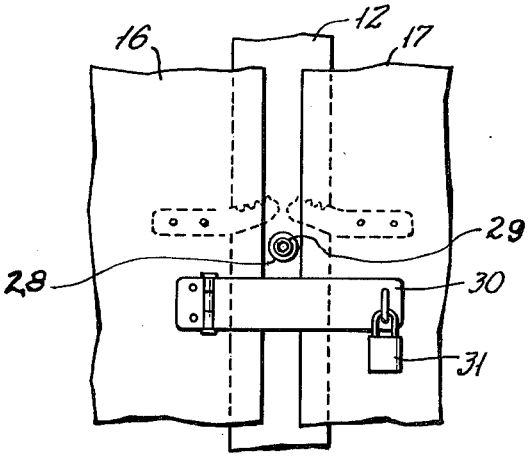
FIG. 5 is a detail of a part of a side view similar to FIG. 1, with both doors shut, showing a padlock and hasp provided for locking them together.

FIG. 5 is a detail view showing that when the doors 16 and 17 are both closed, only a narrow strip of the frame member 12 remains exposed between them, through a hole in which the cup washer 28 appears, within which a hex-head cap 29 on the release shaft of the latch is located for turning the release cam to be described below.

FIG. 5 also illustrates how a hasp 30 can be mounted for enabling the doors 16 and 17 to be locked together by a padlock 31 in those cases in which the security provided by the necessity of a tool fitting a hexagonal socket operating (from outside the cabinet) hex-socket head 29 of the rotary activator of the cam 33 (FIG. 9) not be sufficient. An externally hexagonal actuator head surrounded by the cup washer 28 and turnable with a socket tool could also be used.

Figure 6:
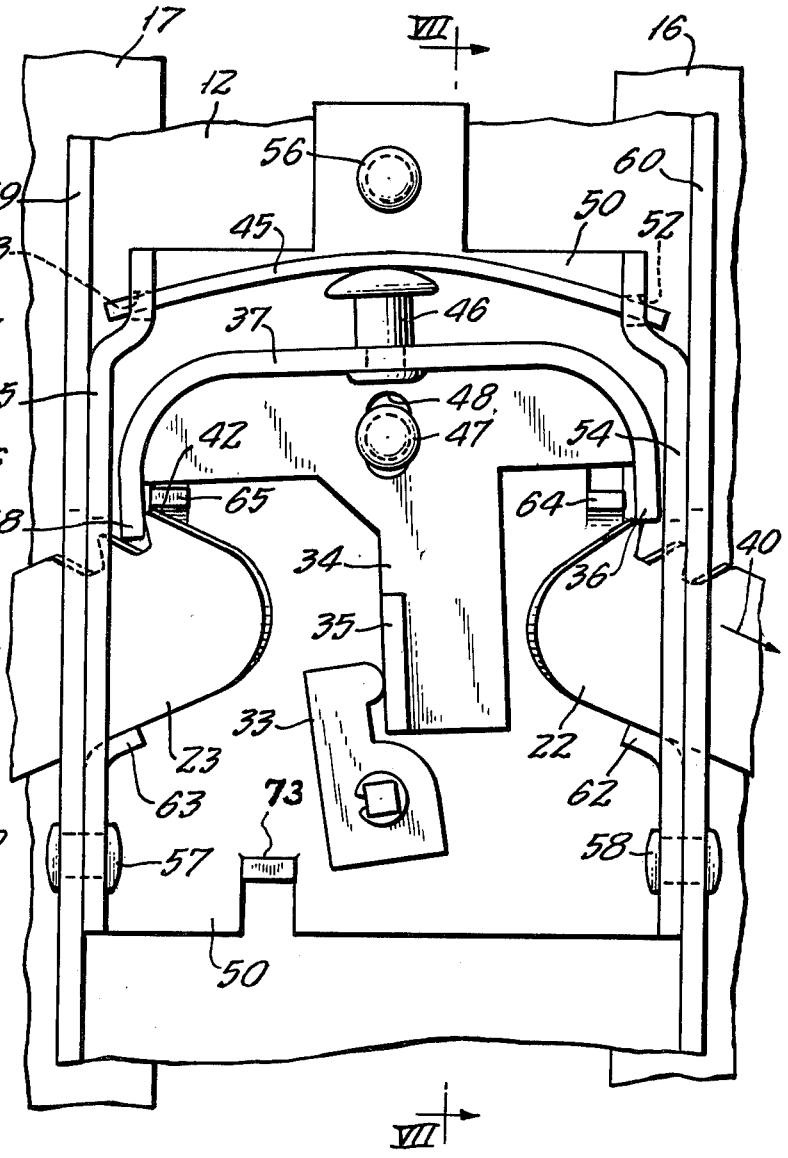
FIG. 6 is a view looking at the latch from the interior of the cabinet, in the condition in which the rear door is held closed, while the front door has just been released by a small movement of the rotary cam.

FIG. 6 is a view of the latch mechanism from the inside of the cabinet, showing the condition of the latch after the cam 33 has displaced the pivot plate 34 just enough, by acting on a flange 35, to cause the detent 36 of the cross member 37 to release the tongue 22 of the front door, which is shown in the process of moving out of the latch as indicated by the arrow 40. The other detent 38 of the cross member 37 holds the tongue 23 of the rear door by a tooth 42 of its upper edge and, in fact, in releasing the tongue 22 in response to the force applied by the cam 38, the cross member 37 pivots on its tip 38 which is held down between the teeth of the tongue 23 by the force of the spring 45 acting through the stud 46 riveted into the cross member 37.

The pivot plate 34, which is fastened, for example by welding, to the cross member 37, has a sliding pivot provided by the loose rivet 47 that passes through an elongated hole 48 in the pivot plate, as well as through a round hole in the base plate 50 of the latch mechanism. The elongation of the hole 48 (which extends vertically in the idle position of the pivot plate, i.e. when neither door tongue extends into the latch and the cam finger 33 is not pressing the flange 35) is necessary in order to permit the cross member 37 to be displaced bodily upwards when both doors are closed at the same time and a piece of the two tongues simultaneously force upwards the ends 36 and 38 of the cross member 37, thus producing a maximum upward bending of the leaf spring 45. The spring 45 exerts some pressure on the stud 46 even in the idle condition of the latch, thus preventing vibrations from creating noise in this essentially loose type of latch mechanism.

The spring 45 is simply a flat piece of spring steel held in slots 52 and 53 in the sidewalls 54 and 55, respectively, of the base plate 50 of the latch. The base plate 50 is riveted in three places, 56, 57 and 58 through the channel-shaped member 12 of the cabinet, the sidewalls 59 and 60 of which eliminate any possibility that the spring 45 should be able to work out endways of its position in the base plate 50.

FIG. 6 shows the oblique guide tabs 62 and 63 bent out of the sidewalls of the base plate 50 in order to guide the tongues 22 and 23 upwards as they are pushed into the latch enclosing the doors, thus correcting the sag of the doors as explained in connection with FIGS. 1 and 2.

Figure 7:
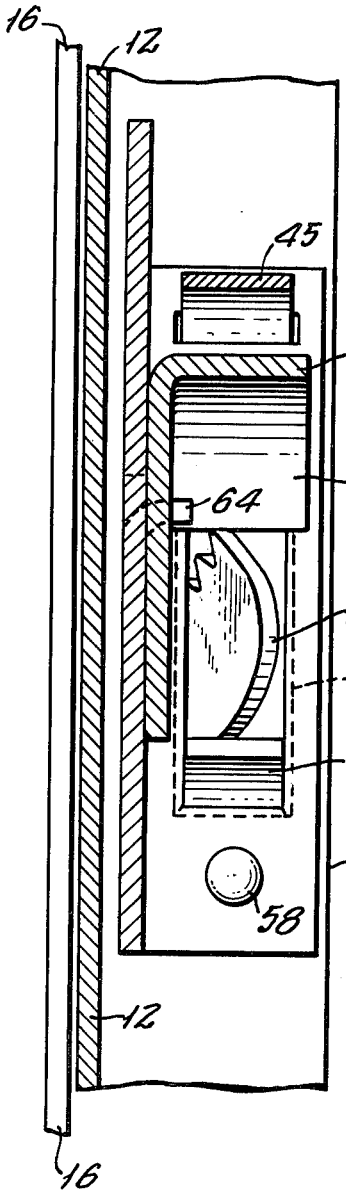
FIG. 7 is a section designated by VII—VII in FIG. 6.

FIG. 7 is a sectional view on the line VII—VII of FIG. 6 looking in a direction which is towards the right in FIG. 6. This section is clear of the edge of the door 16, which appears in FIG. 7 in end view. The sealing strip that would normally be interposed between the door 16 and the frame member 12 has been omitted from FIG. 7 to simplify the illustration.

FIG. 7 shows in profile the tip of the stop 66 bent up out of the base plate 50 to prevent further downward movement of the pivot plate 34 when the door tongue 22 is not there to stop the downward movement of the cross member 37 first. A similar stop 65 is provided at the other side of the base plate 50.

Figure 8:
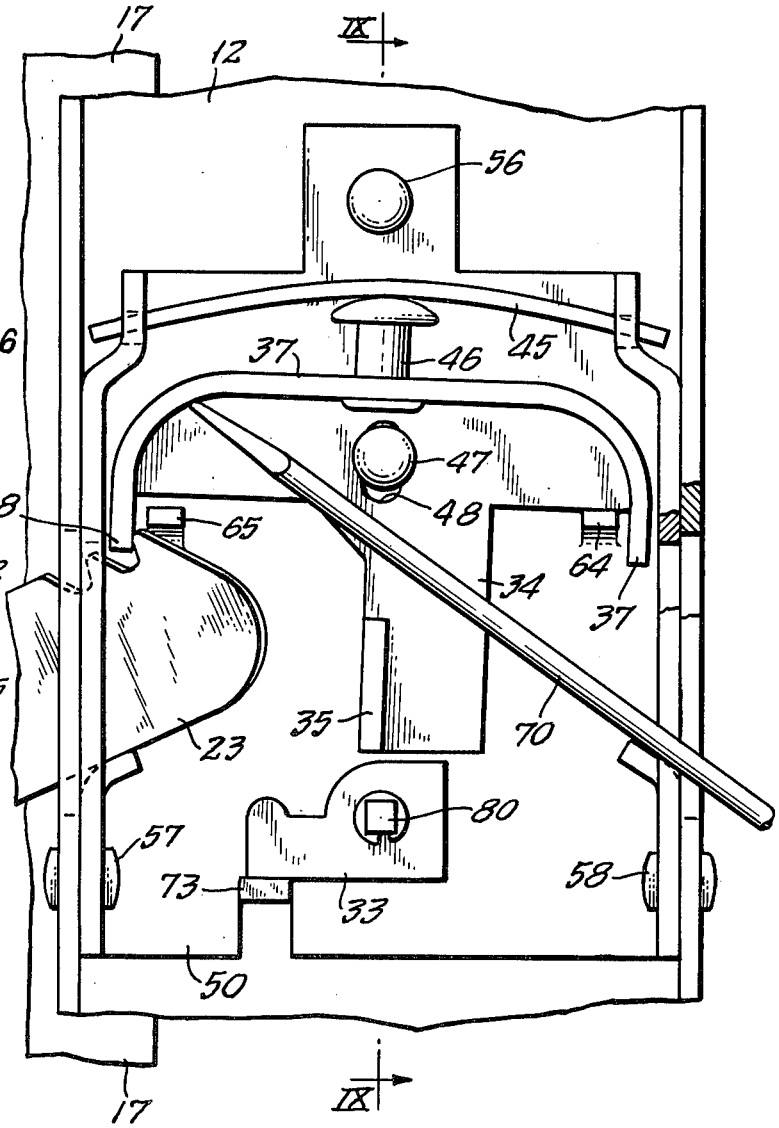
FIG. 8 is a view from the interior of the cabinet looking at the latch in the position when the cross member has been moved by the cam just enough to release the tongue of the front door, while the rear door is held closed.

FIG. 8 shows the latch after the front door 16 has been opened and the back door, still held closed, is about to be opened by insertion of a screwdriver 70 through the slot 72 (shown in the sectional view of FIG. 9, which omits the presence of the screwdriver) in order to push up the detent 38 of the cross member 37 enough to release the door tongue 23. The cam 33 has by this time fallen of its own weight against the stop 73 that is bent out of the base plate 50. As the blade of the screwdriver 70 is pushed against the cross member 37, the pivot plate 34 will now pivot about the stop 64 to raise the detent 38, while the elongated hole 48 of the pivot plate moves upward past the rivet 47 and while the spring 45 is deflected upward by the pressure of the stud 46.

Figure 9:
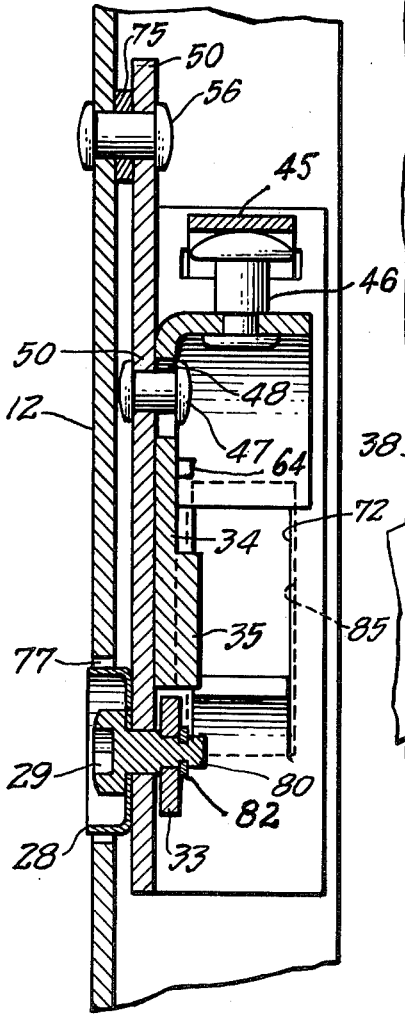
FIG. 9 is a section designated IX—IX in FIG. 8.

FIg. 9, being a median cross section of the latch as shown in FIG. 8, illustrates how the cam 33 is actuated by rotation of the shaft end 80 by a tool as described in connection with FIG. 5 how the sliding rivet 47 terminates in the base plate 50 and how the fastening rivet 56 (which cooperates with the rivets 57 and 58 to hold the base plate 50, as shown in FIG. 8) is provided with a washer 75 on account of the spacing necessary for the lefthand head of the rivet 47 shown in FIG. 9. Of course, if a dimple in the adjacent portion of the frame member 12 were provided for seating that rivet head, the washer 75 would be unnecessary and the base plate 50 could lie flush against the adjacent surface of the frame member 12.

FIG. 9 also shows the hole 77 allowing the cup washer 28, mentioned in connection with FIG. 1, and the head 29 of the cam rotator, to be visible and accessible from the outside. The cam rotator has a cylindrical shaft portion passing through the base plate 50 and terminates inside the latch in a portion 80 of square cross section on which the cam finger 33 is mounted and keyed. A retaining split ring 82 fits into a milled groove in the shaft portion 80 to keep the cam finger 33 from slipping off the shaft. This enables the cam finger 33 itself to keep the shaft from being pulled out from the outside.

The rotary cam finger 33 will cause the detent 38 of the cross arm 37 to disengage from the door tongue 23 after less than a full turn of rotation of the cam in abutment against the actuating lever 34,35, the rotary cam 33, as shown in FIG. 9, has a shaft rotatably mounted in fixed relation to the channel-shaped frame member 12 and passing through it and connecting the cam to means 29 enabling the shaft to be rotated by a specially shaped tool (as described in connection with FIG. 5) from the outside of the cabinet.

The flange 35, through which the section plane passes in this particular position, appears in section in FIG. 9.

FIG. 9 also shows one of the sides 60 of the channel-shaped frame member 12, both of which appear in FIG. 6, and the stop 64 of the pair of stops 64 and 65 shown in FIG. 6 as bent out of the plate 50, as well as the door 16 which is about to be released (see arrow on FIG. 6) from the closed position.

The frame member 12 needs to be slotted in the same manner as the sidewalls of the base plate 50 for the passage of the door tongues into the flange. The slots in the frame member 12 are preferably made somewhat bigger, as shown by the broken line 85 in FIG. 7 and FIG. 9. Thus, the base plate 50 can be made of stainless steel, as the tongues 22 and 23 would normally be constituted also, while the channel 12 may be made of a structural steel that does not need to withstand wear and may be simply painted for protection against corrosion, since its edges will not be subjected to wear by the opening and closing of the doors.

Although the invention has been described with reference to a particular illustrative embodiment, it will be understood that variations and modifications are possible within the inventive concept.

We claim:

1. An apparatus cabinet having a frame comprising parallel first and second side members each providing a portion of the outside surface of the cabinet, at least one spacing member between the side members, a cover member, base housing pieces attached to the side members to enclose the lower portion of the cabinet, and at least one door having lateral lips extending around cabinet corners to overlap said side members, being hinged to said first side member and further comprising:

a latch on the interior side of said second side member, said latch having an access slot for forcing said door and having an inclined surface guide at the bottom thereof and a tongue on said door positioned for engagement in said latch through said access slot thereof;

said door having its middle bowed inwardly in the unstressed condition of the door with respect to said lips about a vertical axis of curvature, for facilitating clearance of the outer lip from the cabinet corner in closing the door, said tongue having teeth on an edge thereof for engaging said latch and projecting upward at a small angle to the horizontal whereby the bottom edge of said tongue may automatically find said inclined surface guide of said access slot as said door is normally closed and the further sliding contact of said tongue on said guide will raise the door in further closing to the extent necessary for correcting sag, said latch having a pivoted detent for catching said teeth of said tongue and spring means for pressing said detent against said tongue, said pivoted detent having an actuating arm, said latch also having a freely rotatable cam finger, rotatably mounted in said latch, for engaging said actuating arm of said pivoted detent of said cam for release of said tongue, said cam finger having a shaft for rotating said cam, said shaft extending from said latch to the exterior of said cabinet through said second side member and having a shaped extremity for actuation by a suitable tool, said door being made of sheet metal of such gauge and flexibility that the closing and locking of said door with insertion of said tongue in said latch substantially straightens out the bow of the middle portion of said door against adjacent portions of the cabinet overlapped respectively by the top and bottom edges of said door.

2. An apparatus cabinet as defined in claim 1, in which said teeth of said tongue are located on the upper edge thereof, said tongue extends inwardly of the plane of the lip of said door to which it is fastened, said detent of said latch projects downwardly and said spring means urge said detent downwardly.

3. An apparatus cabinet having a frame comprising parallel first and second side members each providing a narrow vertical strip of the exterior surface of the cabinet, and at least one spacing member between the side members, a cover member, a base housing portion and hinged doors respectively at front and back, which when closed complete the cabinet closure between said side members and between said base housing portion and said cover, said cabinet comprising the improvement which consists in that:

the doors are both hinged on the same side of said first side member and extend across the entire width of the cabinet and have lateral lips extending around the cabinet sides and overlap both frame members when the door is closed, hinges being fastened to one lip and a projecting catch tongue to the other lip, said catch tongue having at least one tooth;

a releasable latch is provided associated with guide apertures into which the respective tongues of both doors may penetrate, said latch also having a cross member having at each end a detent for catching one of said catch tongues by a tooth thereof, said cross member being connected in its end portion to the middle of a resilient member mounted at its ends in fixed relation to said second side member and urging it in a direction for engaging said detents into said tongues, said resilient member being deformable so as to permit said cross member to be moved to disengage either detent from a tongue member of one of said doors, said cross member having, in fixed relation thereto, an actuating lever, said cross member and actuating lever having a common pivot mounted in a manner permitting sliding movement relative to said base plate towards and away from said resilient member; and a rotary cam finger is provided for bearing against and rotating said actuating lever for causing a detent of said cross member to disengage from a door tongue after less than a full turn of rotation of said cam in abutment against said actuating lever, said rotary cam having a shaft rotably mounted in fixed relation to said second side member and passing through the latter and connecting said cam to means enabling said shaft to be rotated by a specially shaped tool from the outside of said cabinet.

4. An apparatus cabinet as defined in claim 3, in which said latch is provided with a base plate having lateral walls in which said guide apertures are provided, and on which said common pivot of said cross member and said actuating lever is secured, as well as the rotary mounting of said shaft of said cam, said base plate being fastened to said second side member and said second side member having the necessary apertures for accommodating the function of said latch.

5. An apparatus cabinet as defined in claim 4, in which said resilient member is a leaf spring having its ends supported in slots in said lateral walls of said base plate and in which said cross member is fitted with a spacing stud against which said resilient member bears for transmission of force from said resilient member to said cross member.

6. An apparatus cabinet as defined in claim 4, in which said detents of said cross member are downwardly projecting and in which said at least one tooth of each of said door tongues is located on the upper edge of the tongue.

7. An apparatus cabinet as defined in claim 4, in which said base plate is provided with projecting stops for restraining movement of the ends of said cross member under pressure of said resilient member when no door tongue is engaged with the corresponding end of said cross member.

8. An apparatus cabinet as defined in claim 4, in which guide tabs are bent out at an oblique angle from said lateral walls of said base plate at the respective lower ends of said guide apertures for guiding said door tongues upward as the corresponding door approaches its closed position, whereby the sag of the door under its own weight is corrected by the time the door is held closed by said latch.

9. An apparatus cabinet as defined in claim 4, in which said actuating lever and said rotary cam are of such respective configurations that only one of said doors can be released by rotation of said cam shaft and said latch is so disposed and located on the interior side of second side member that the other of said doors can be released after the other of said doors is open by the application of a prodding tool passing through the guide aperture for the open door in said base plate and applied against a portion of said cross member near the detent latching the tongue of the closed door.

10. An apparatus cabinet as defined in claim 3 or claim 4, in which said doors are bowed inward in the middle about a vertical axis enough to facilitate the clearance of the outer lip of the door bearing said tongue around the cabinet corner enclosing, the door being made of sheet metal of sufficient flexibility to allow the door to be pulled flat at its upper and lower edges at a small overlap of the fixed cabinet structure there, as the door is closed into its locked position.

11. An apparatus cabinet as defined in claim 1,2,3,4,5,6,7,8 or 9, in which said doors are provided, respectively, in the neighborhood of their said tongues with means for attaching a padlock for locking the doors together for additional security.

* * * * *